US010151317B2

(12) United States Patent
Cobbett

(10) Patent No.: US 10,151,317 B2
(45) Date of Patent: Dec. 11, 2018

(54) VACUUM SYSTEM SECURING DEVICES

(71) Applicant: Edwards Limited, West Sussex (GB)

(72) Inventor: Andrew Cobbett, Portslade (GB)

(73) Assignee: Edwards Limited, Burgess Hill, West Sussex (GB)

( * ) Notice: Subject to any disclaimer, the term of this patent is extended or adjusted under 35 U.S.C. 154(b) by 347 days.

(21) Appl. No.: 14/910,950

(22) PCT Filed: Jul. 9, 2014

(86) PCT No.: PCT/GB2014/052099
§ 371 (c)(1),
(2) Date: Feb. 8, 2016

(87) PCT Pub. No.: WO2015/019046
PCT Pub. Date: Feb. 12, 2015

(65) Prior Publication Data

US 2016/0195095 A1 Jul. 7, 2016

(30) Foreign Application Priority Data

Aug. 9, 2013 (GB) ..... 1314282.3

(51) Int. Cl.
*F04D 19/04* (2006.01)
*F04D 29/60* (2006.01)

(52) U.S. Cl.
CPC ..... *F04D 19/042* (2013.01); *F04D 29/601* (2013.01)

(58) Field of Classification Search
CPC ..... E04G 21/3209; E04G 21/3223; E04G 21/3233; E04G 21/3242; E04G 21/3261;
(Continued)

(56) References Cited

U.S. PATENT DOCUMENTS 2,010,659 A * 8/1935 Ferris ..... E05D 11/04 16/276
4,643,472 A * 2/1987 Schukei ..... B66C 1/56 294/82.28

(Continued)

FOREIGN PATENT DOCUMENTS

EP 2228540 A2 9/2010
WO 2006000745 A1 1/2006

OTHER PUBLICATIONS

Combined Search and Examination Report under Sections 17 and 18(3) dated Feb. 10, 2014 in corresponding GB Application No. 1314282.3, 5 pgs.

(Continued)

*Primary Examiner* — Amber R Anderson
*Assistant Examiner* — Nahid Amiri
(74) *Attorney, Agent, or Firm* — Westman, Champlin & Koehler P.A.; Theodore M. Magee

(57) ABSTRACT

A vacuum system securing device to releasably secure a sealed connection between a first part and a second part of a vacuum system has a shaft having a longitudinal axis and is provided with a plurality of force applying members. The shaft is to be attached to the first part of the vacuum system to define a gap between the first part and the force applying members to receive the second part by a movement of the second part in a lengthways direction of the shaft. The shaft is movable relative to the first part to cause the force applying members to narrow the gap to apply a force pressing the second part towards the first part.

19 Claims, 7 Drawing Sheets

(58) Field of Classification Search
CPC . E04G 21/3266; E04G 5/14; E04G 2005/148; E04G 21/3214; E04G 321/04; F04D 19/042; F04D 29/601; H01J 49/24
USPC ..... 403/374.1; 250/289
See application file for complete search history.

(56) References Cited

U.S. PATENT DOCUMENTS

| | | | | |
|---|---|---|---|---|
| 5,472,037 | A * | 12/1995 | Hoffman | E05D 7/009 160/118 |
| 5,779,388 | A * | 7/1998 | Yamamoto | H05K 7/1404 361/741 |
| 6,386,789 | B1 * | 5/2002 | Chausse | F16B 21/165 403/322.2 |
| 6,887,022 | B2 * | 5/2005 | Choate | F16B 2/16 24/453 |
| 8,480,329 | B2 * | 7/2013 | Fluhr | F41A 11/00 403/319 |
| 9,689,185 | B2 * | 6/2017 | McInnis | E05D 3/022 |
| 2010/0150648 | A1 | 6/2010 | Judge et al. | |

OTHER PUBLICATIONS

International Search Report and the Written Opinion of the International Searching Authority dated Oct. 21, 2014 in corresponding International Application No. PCT/GB2014/052099, 10 pgs.

* cited by examiner

VACUUM SYSTEM SECURING DEVICES

This application is a national stage entry under 35 U.S.C. § 371 of International Application No. PCT/GB2014/052099, filed Jul. 9, 2014, which claims the benefit of G.B. Application 1314282.3, filed Aug. 9, 2013. The entire contents of International Application No. PCT/GB2014/052099 and G.B. Application 1314282.3 are incorporated herein by reference.

TECHNICAL FIELD

The disclosure relates to vacuum system securing devices able to secure a sealed connection between two parts of a vacuum system.

BACKGROUND

In vacuum systems it is often necessary to form a sealed connection between two parts, or devices. For example, a vacuum pump may be connected with an analysing device such as a mass spectrometer. The vacuum pump may be used to evacuate one or more chambers in the mass spectrometer and this requires a sealed connection(s) between the vacuum pump and the mass spectrometer.

FIG. 1 is a perspective view of a turbo molecular pump 10 that may be connected to a mass spectrometer to evacuate a plurality of chambers in the mass spectrometer, for example as disclosed in WO2006/000745. The pump 10 comprises a pump body 12 provided with a flange 14. The flange 14 has a planar face 16 provided with grooves 18 for respective sealing elements, such as O-rings. The flange 14 is provided with a plurality of apertures 20 through which respective fastening elements, for example bolts, can be inserted into respective threaded apertures provided in a flange or other planar surface of the mass spectrometer. The longitudinal axis of the fastening elements extends perpendicular to the plane of the planar face 16.

The pump 10 may be located on the underside of, or other locations on, the mass spectrometer that are relatively difficult to access. This may give rise to difficulties both at the initial installation stage and subsequently in the event the pump requires replacement or repair, or the sealing element between the pump and mass spectrometer requires replacement. It is also necessary to perform individual tightening operations to tighten and secure each bolt, which can be particularly time-consuming if the bolt heads are difficult to access.

SUMMARY

The disclosure describes a vacuum system securing device as specified in claim 1.

The disclosure also describes a vacuum system as specified in claim 10.

BRIEF DESCRIPTION OF THE DRAWINGS

In the following disclosure, reference will be made to the drawings.

DETAILED DESCRIPTION

Figure 2:
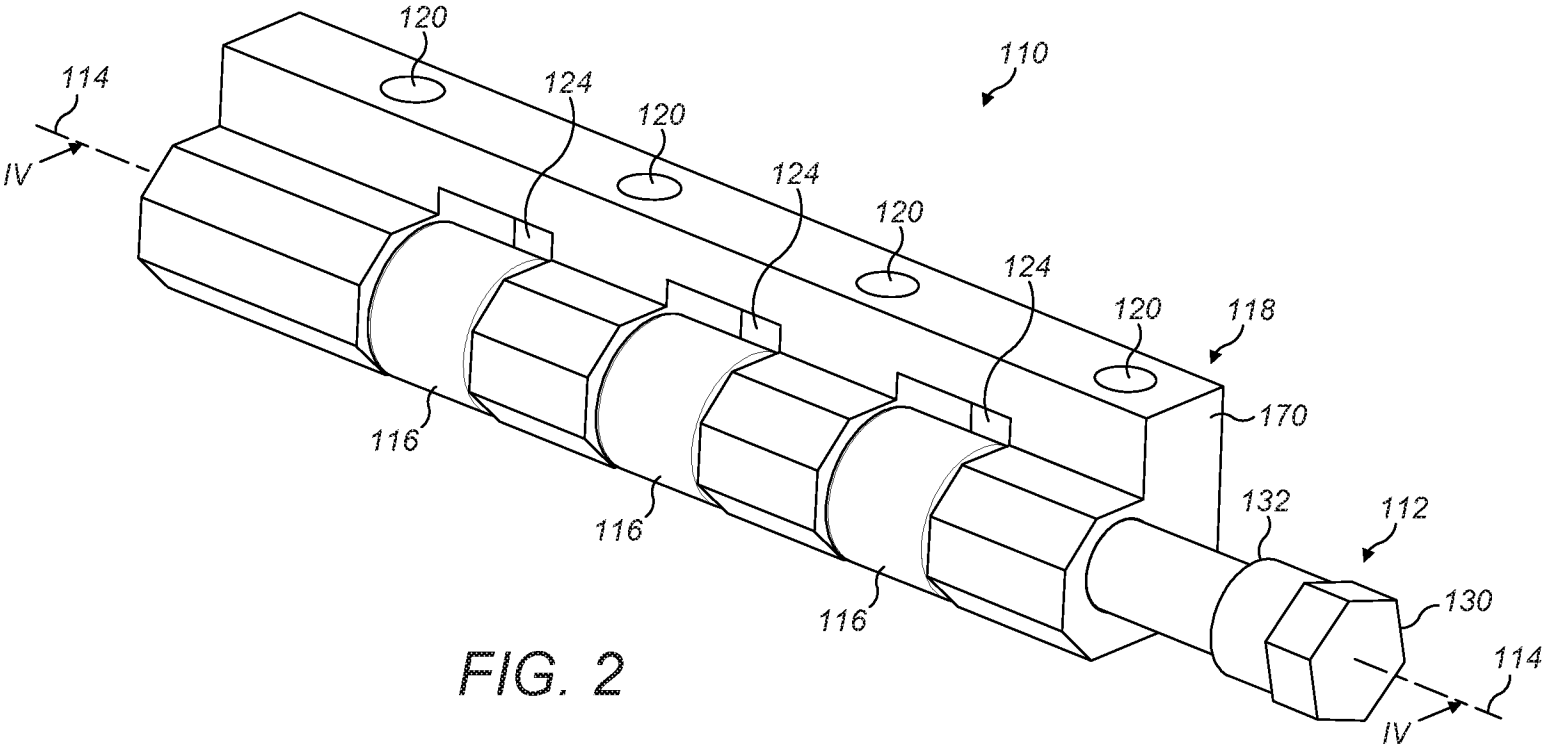
FIG. 2 is a perspective view of a vacuum system securing device.
Figure 3:
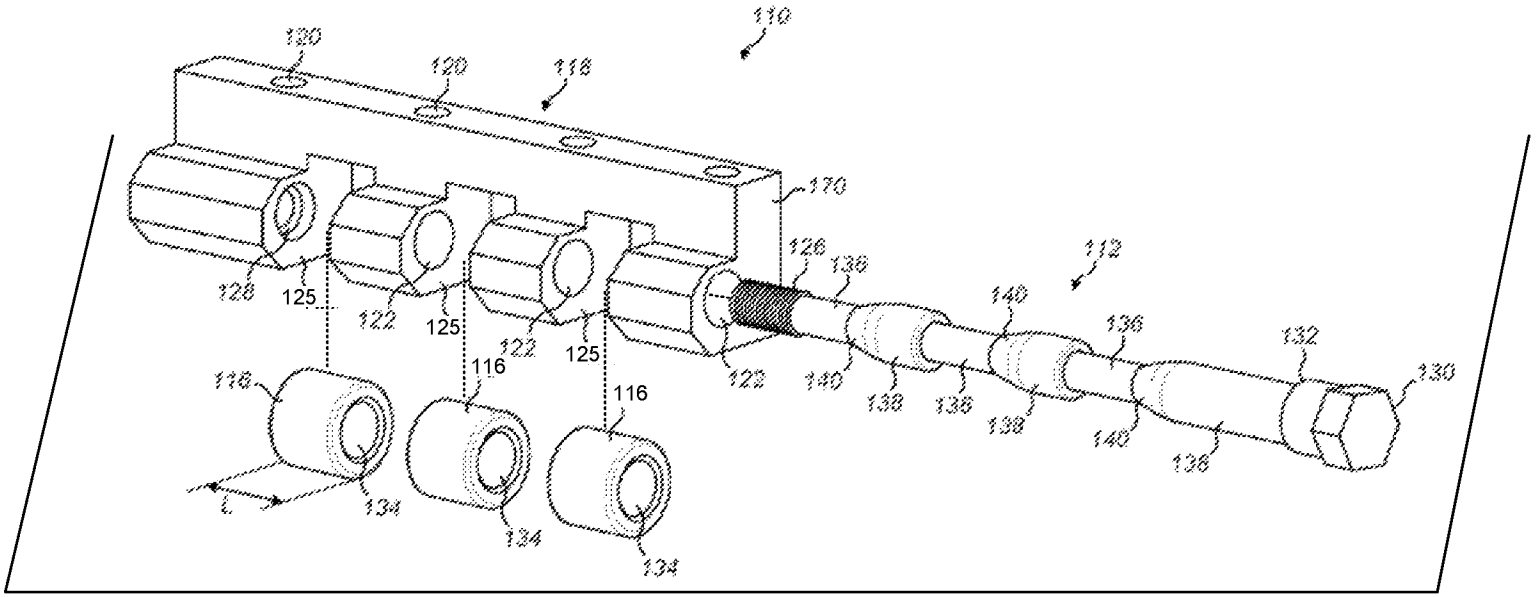
FIG. 3 is an exploded perspective view of the vacuum system securing device of FIG. 2.

Referring to FIGS. 2 and 3, a vacuum system securing device 110 to releasably secure a sealed connection between a first part and a second part of a vacuum system comprises a shaft 112 having a longitudinal axis, which in this example is an axis of rotation 114. The shaft 112 is provided with a plurality of force applying members 116. In use, the shaft 112 is attached to the first part of the vacuum system to define a gap between the first part and the force applying members 116 to receive the second part. The shaft 112 is rotatable about the axis of rotation 114 to cause the force applying members 116 to narrow the gap to apply a force that presses the second part towards the first part.

The vacuum system securing device 110 further comprises a mounting 118 by which the shaft 112 can be mounted to the first part of the vacuum system. In the illustrated example, the mounting 118 is provided with a plurality of through-holes 120 to permit it to be releasably secured to the first part of a vacuum system by means of bolts, screws or the like.

The mounting 118 has a generally L-shaped cross-section and is provided with a bore 122 in which the shaft 112 is partially received. The mounting 118 is provided with a plurality of apertures 124 that extend transversely with respect to the bore 122 so as to divide it into sections and provide respective spaces to receive the force applying members 116. In the axial direction of the bore 122, the apertures 124 have a width W defined by opposed faces 125. The width W corresponds substantially to the length L of the force applying members 116 so that the force applying members can move transversely of the bore 122, but are constrained against any substantial movement in the axial direction of the bore.

A first end of the shaft 112 is provided with threading 126, which in the illustrated example is male threading configured to engage in female threading 128 (best seen in FIGS. 4 and 5) provided in an end section of the bore 122. A second end of the shaft 112 is provided with a drive head 130 and a shoulder defining a stop surface 132. In the illustrated example, the drive head 130 is a hexagonal head to allow the application of a rotational force to the shaft 112 by means of a spanner (wrench) or the like. In other examples, the drive head may alternatively, or additionally, incorporate a socket to receive a suitably shaped drive member, such as an Allen (hex) key, and in principle the drive head may be configured in any desired way so as to be able to receive a rotational input force to turn the shaft 112 about the axis of rotation 114.

The force applying members 116 are annular bodies defining respective through-holes 134 to receive the shaft 112. Although not essential, as they may be made of metal or any other suitable material, in the illustrated example the force applying members 116 are made from an engineering plastics such as nylon.

Figure 4:
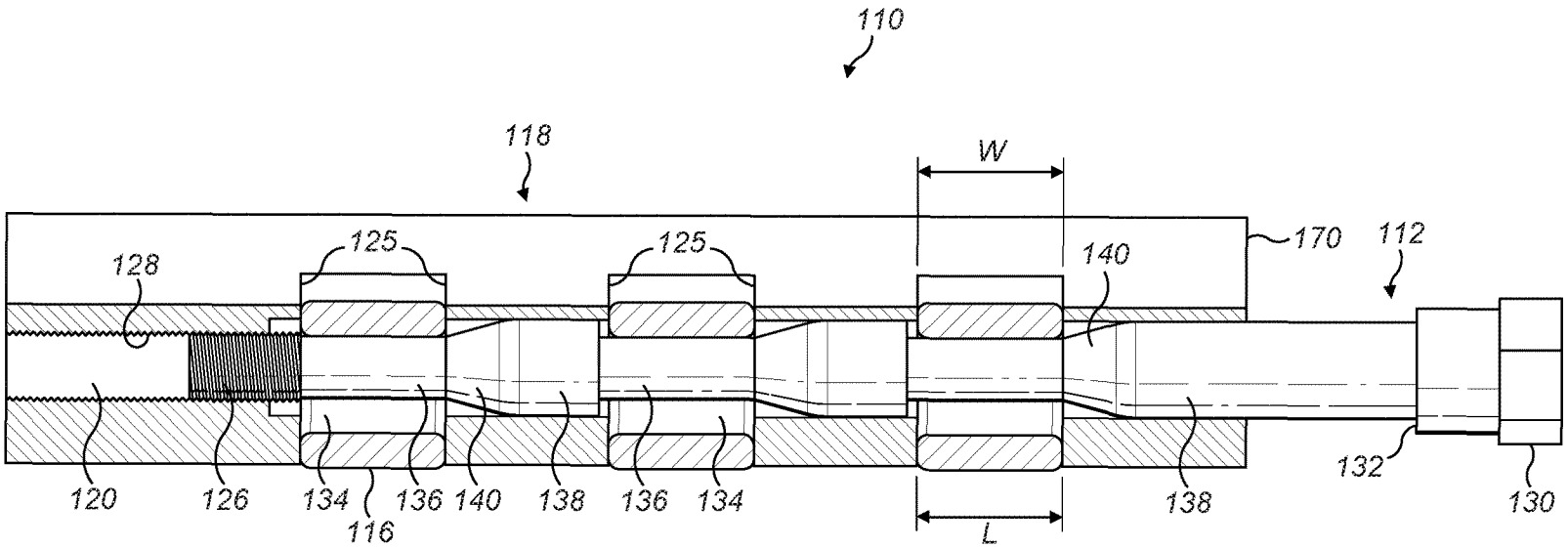
FIG. 4 is a section on line IV-IV in FIG. 2 showing the vacuum system securing device in a first operating condition.
Figure 5:
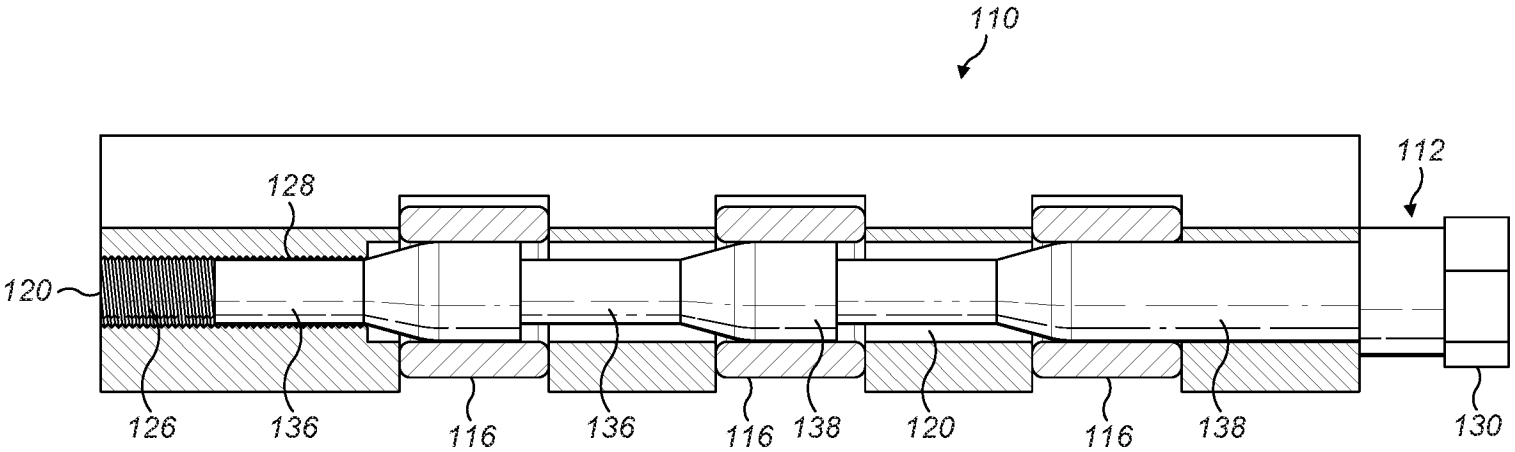
FIG. 5 is a view corresponding to FIG. 4 showing the vacuum system securing device in a second operating condition.

The shaft 112 has respective first diameter portions 136 for the force applying members 116 that separate respective associated second diameter portions 138. The second diameter portions 138 have a larger diameter than the first diameter portions 136. The diameter of the second diameter portions 138 corresponds substantially to the diameter of the through-holes 134 so that the force applying members 116 are a close sliding fit on the second diameter portions. Adjacent first and second diameter portions 136, 138 are joined by respective conical sections 140. As will be described in more detail below, when the shaft 112 is screwed into the bore 122, it translates relative to the force applying members 116 in the axial direction of the bore. As shown in FIGS. 4 and 5, this axial translation moves the first diameter portions 136 out of alignment with the force applying members 116 and brings the force applying members into engagement with the respective second diameter portions 138. The engagement of the force applying members 116 by the second diameter portions 138 causes a radial movement of the force applying members with respect to the shaft 112. The radial movement of the force applying members 116 is guided by the opposing faces 125 of the apertures 124. The conical sections 140 assist in providing a smooth transition as the second diameter portions 138 move into engagement with the through-holes 134 of the force applying members.

Referring to FIGS. 6 to 10, a mass spectrometer 150 comprises a first part of a vacuum system in the form of a member 152 that has a planar surface 154 that forms an underside of the mass spectrometer. Two vacuum system securing devices 110 are secured to the planar surface 154 by means of bolts 156 (FIGS. 9 and 10) extending through the through-holes 120 of the respective mountings 118 and engaging in threaded apertures (not shown) provided in the member 152. Respective gaps 158 are defined between the planar surface 154 and the force applying members 116 of the vacuum system securing devices 110.

Figure 8:
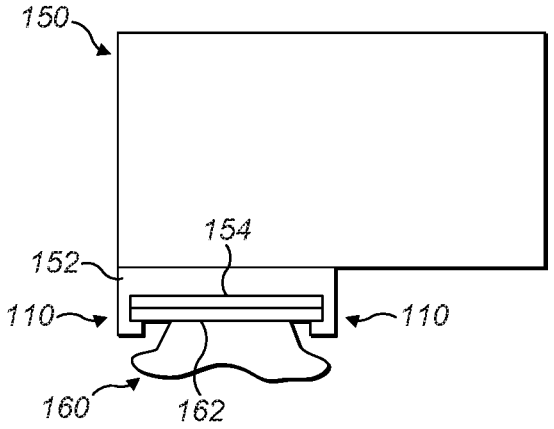
FIG. 8 is a schematic view corresponding to FIG. 6 showing a turbo molecular vacuum pump comprising a second part of the vacuum system assembled to the mass spectrometer.
Figure 9:
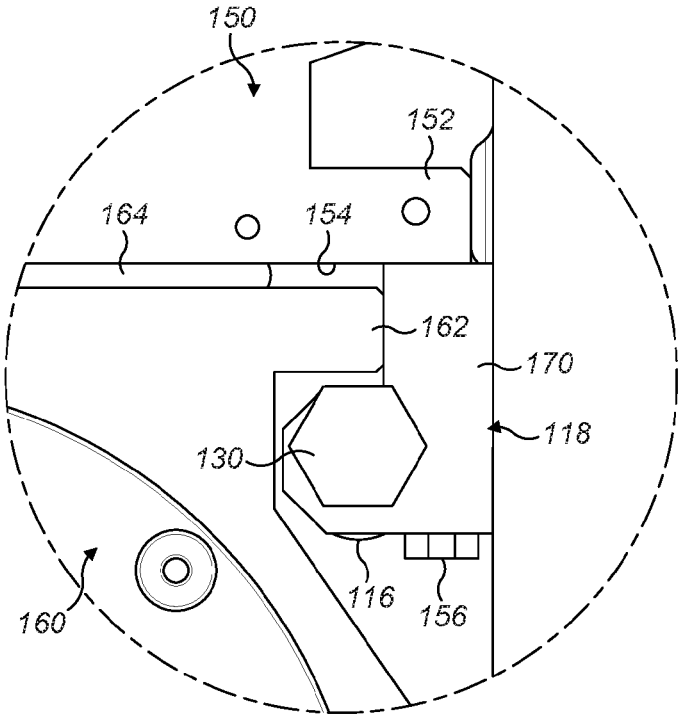
FIG. 9 is an enlarged view of the vacuum system showing one of the vacuum system securing devices in the operating condition of FIG. 4.
Figure 10:
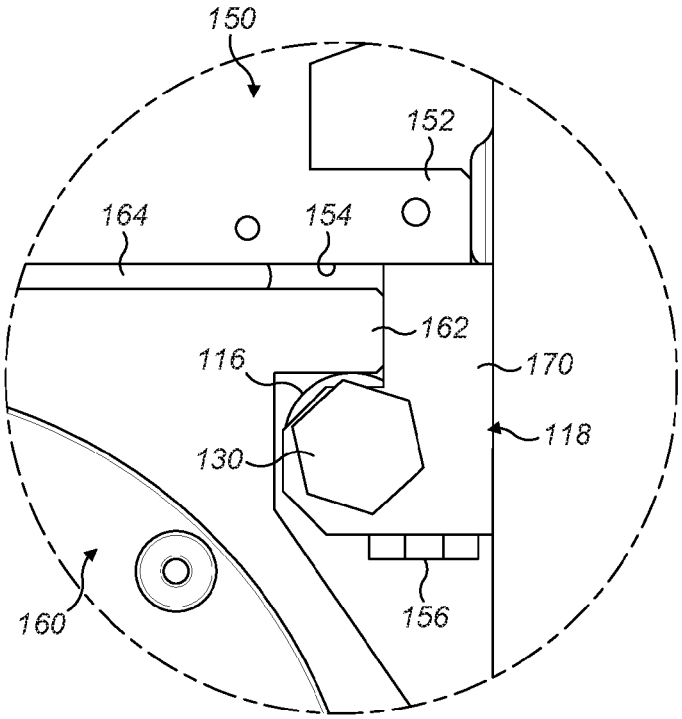
FIG. 10 is a view corresponding to FIG. 9 showing the vacuum system securing device in the operating condition of FIG. 5.

Referring to FIGS. 8 to 10, the vacuum system further comprises a turbo molecular vacuum pump 160. The vacuum pump 160 comprises a second part of the vacuum system in the form of a flange 162. The vacuum pump 160 is secured to the mass spectrometer 150 for evacuating a plurality of chambers in the mass spectrometer, for example as described in WO2006/000745. The flange 162 may have a groove or other suitable formation (not shown) to partially receive a sealing element 164 (FIGS. 9 and 10). The sealing element 164 may take the form of an O-ring or any other sealing element suitable for sealing a connection between two parts of a vacuum system.

Figure 6:
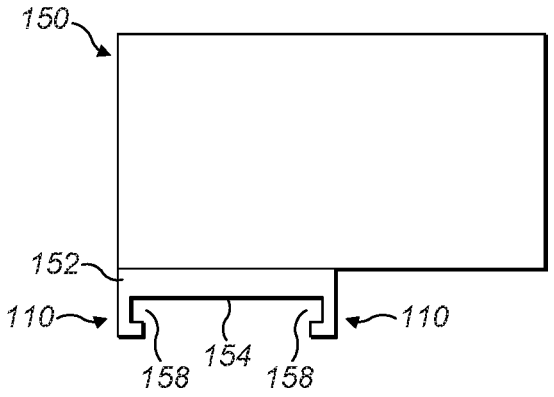
FIG. 6 is a schematic end elevation of a mass spectrometer comprising a first part of a vacuum system and two vacuum system securing devices.
Figure 7:
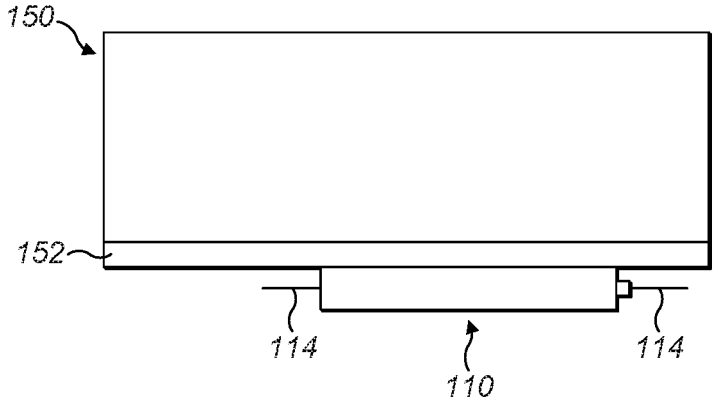
FIG. 7 is a schematic side elevation of the mass spectrometer of FIG. 6.

Referring to FIGS. 6 to 8, the vacuum pump 160 is assembled to the mass spectrometer 150 by inserting the flange 162 into the gaps 158 defined by the vacuum system securing devices 110. The vacuum system securing devices 110 define a guide way 166 along which the flange 162 is moved generally parallel to the axis 114 to assemble the vacuum pump 162 to the mass spectrometer 150. Once assembled, the sealing element 164 is in engagement with the planar surface 154, but with insufficient pressure to form a vacuum seal. The vacuum system securing devices 110 are then operated to secure the flange 162 to the member 152 with a vacuum seal between them.

The operation of the vacuum system securing devices 110 is the same for each so for economy of presentation, operation of only one will be described here. A wrench (not shown) is applied to the drive head 130 and used to apply a torque to the shaft 112 to rotate it about the axis 114. The rotation of the shaft 112 causes it to translate axially in the bore 122 moving it from the position shown in FIG. 4 to the position shown in FIG. 5. This moves the first diameter portions 136 out of alignment with the force applying members 116, which are brought into engagement with the second diameter portions 138. As the respective conical sections 140 and, subsequently, the second diameter portions 138 engage the force applying members 116, the force applying members move radially with respect to the axis 114 guided by the opposed faces 125 of the respective apertures 124. The engagement of the stop surface 132 with the opposed end face 170 of the mounting 118 provides an indication that the second diameter portions 138 are engaging the force applying members 116 and the connection is sealed and secured. As can be seen from a comparison of FIGS. 9 and 10, this movement of the force applying members 116 narrows the gap 158 between the member 152 and flange 162 to increase the pressure applied to the sealing element 164 to seal the connection between the two parts.

If the sealed connection between the mass spectrometer 150 and vacuum pump 160 needs to be released in order to permit repair to either part or replacement of the pump or sealing element 164, this can be accomplished by simply rotating the shaft 112 in the opposite direction to bring the first diameter portions 136 back is into alignment with the force applying members 116, so that the force applying members can move away from the member 152 thereby increasing the size of the gap 158 to allow removal of the vacuum pump. In the illustrated example, once in alignment with the first diameter portions 136, the force applying members 116 will tend to drop away from the member 152 under the influence of gravity thereby widening the gap 158.

Although in the illustrated example the vacuum system securing device is releasably secured to the first part of the vacuum system by means of bolts, it will be understood that the mounting may be attached to the vacuum system in any convenient way and it is not essential that the mounting is releasably securable to the vacuum system. For example, at least a part of the mounting may be an integral part of the vacuum system or permanently secured to the vacuum system by means of welding or the like.

In the illustrated example, the force applying members are separate from the shaft and the shaft is configured to actuate the force applying members by a camming action obtained by an axial sliding movement of the shaft relative to the force applying members. The axial sliding movement of the shaft is obtained by rotating the shaft about its longitudinal axis. In other examples, the shaft may be axially slidable only. A shaft that is axially slidable only may be spring biased to a position in which the force applying members are axially aligned with the first diameter portions of the shaft and slidable to a position in which the second diameter portions are at least partially received in the force applying members by an axially directed force applied by, for example, a separate rotatable member. Thus, for example, the threading 126 of the illustrated shaft 112 could be omitted and the shaft driven by a thumbscrew engaging in threading in the section of the bore 122 nearest the drive head 130.

In other examples, the force applying members may be integral with the shaft so that they rotate when the shaft is rotated. The force applying members may, for example, be discs mounted eccentrically with respect to the longitudinal axis of the shaft. In such an example, portions of the periphery of the discs disposed radially closer to the longitudinal axis of the shaft may be positioned opposite the first part of the vacuum system to define a gap to allow the second part of the vacuum system to be assembled the first part and the shaft then rotated to bring portions of the periphery of the discs disposed radially further from the longitudinal axis into position to narrow the gap and thereby cause the second part to be pressed towards the first part.

In the illustrated example, there is just one sealing element between the two parts of the sealed connection. It will be understood that this is not essential and that there may be a plurality of sealing elements sealing respective discrete flow paths between the two parts.

In the illustrated example, the force applying members are disposed in axially spaced apart relation on the shaft and when actuated they substantially simultaneously increase the pressure applied to the opposed portions of the first part of the vacuum system. The force applying members act in unison so there is a substantially even pressure applied by the vacuum securing device to the first part along the length of the vacuum securing device. In other examples, the force applying members may apply a force in a staggered fashion. For example, the shaft may be configured so that the second diameter portions engage the respective force applying members one after another in a predetermined order, or rotatable force applying members may be configured to increase the applied pressure in a sequential manner.

In the illustrated example there are three force applying members. It is to be understood that the number of force applying members can be selected based on the length to be sealed and desired separation between the positions at which force is applied.

Figure 1:
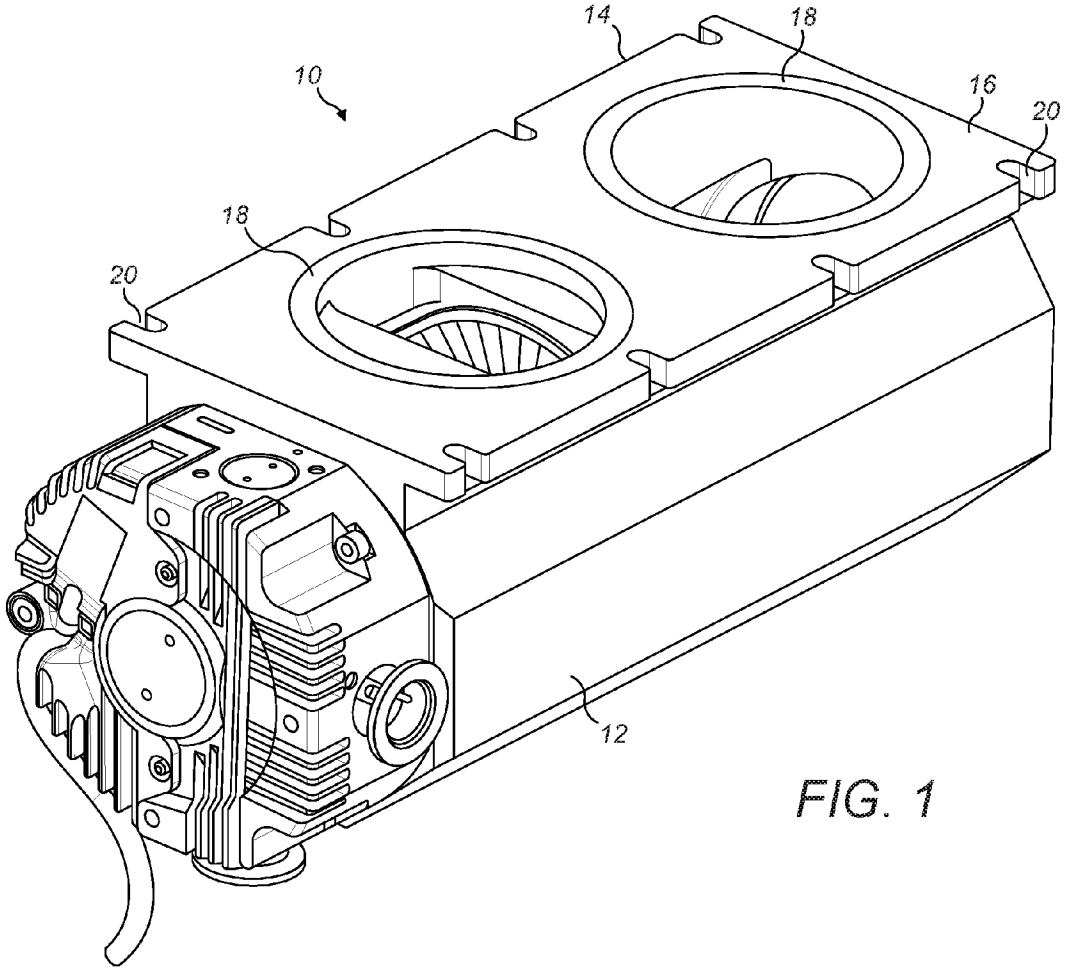
FIG. 1 is a perspective view of a known vacuum pump.

It is to be understood that the illustrated vacuum system securing device facilitates the assembly of parts to a vacuum system in positions in which this might be extremely difficult using a conventional vacuum system securing device, such as a series of bolts penetrating a flange as illustrated in FIG. 1. The vacuum system securing device allows the insertion of a part between two surfaces in a direction generally parallel to the two surfaces and generally parallel to the longitudinal axis of the shaft of the vacuum system securing device. The vacuum system securing device can be positioned such that the end at which drive is applied to the shaft is to one side of a space defined between the two surfaces so that it can be easily accessed. Thus, in cases in which one of the surfaces is the ground or some other surface on which the apparatus or system is supported, parts of an apparatus, or system, do not have to be raised as they would need to be using a conventional arrangement as shown in FIG. 1. In cases in which the two surfaces are each parts of an apparatus or a system, it is not necessary to dismantle the apparatus, or system, to access securing bolts as it would be using the conventional arrangement shown in FIG. 1. In general, the vacuum system securing device allows the possibility of placing the driven end of the securing device at an accessible location to one side of a space to allow one part to be secured to another part when access to the space is restricted such as to make it difficult, or impossible, to use the conventional arrangement shown in FIG. 1.

It is to be understood that the illustrated vacuum system securing device provides advantages in terms of speed of assembly of two parts. Using a conventional vacuum system securing device comprising bolts extending through a flange as shown in FIG. 1, it is necessary to tighten each bolt individually. Thus, in the example shown in FIG. 1, it is necessary to carry out six tightening operations. Using two of the illustrated vacuum system securing devices, one disposed on each side of the flange in parallel spaced apart relation, instead of conventional bolts would require just two tightening operations and yet still produce the six applied forces achieved using six bolts so that respective forces can be applied at spaced apart locations along a desired length of a part by a significantly smaller number of tightening operations.

In the illustrated example, the vacuum system securing device is used to secure a turbo molecular pump to a mass spectrometer. It will be appreciated that application of the securing device is not so limited and that in principle it may be used in securing connections between any two parts that are to be clamped to one another and one of which comprises a relatively thin flange-like portion that can be received in the gap defined between the force applying members and the other part. For example, the securing device could be used to secure the mass spectrometer chamber to its time of flight (TOF) tube. It is not essential that a seal is formed between the parts secured to one another by the securing device, which could, for example, be used to secure covers, lids or the like to housings.

The disclosure has been disclosed with reference to vacuum systems and securing a sealed connection between two parts of a vacuum system. It is to be understood that the application is not so limited and the securing device may be used to secure connections between two parts of a vacuum system that are not sealed and more generally to two parts that are simply to be released to be secured to one another.

The invention claimed is:

1. A vacuum system securing device to releasably secure a first part of a vacuum system to a second part of the vacuum system, the securing device comprising:

a shaft having a longitudinal axis and provided with a plurality of force applying members, wherein the shaft is configured to be attached to the first part to define a gap between the first part and the force applying members, wherein the gap is configured to receive the second part by a movement of the second part in a lengthways direction of the shaft, and wherein the shaft is movable relative to the first part to cause the force applying members to narrow the gap to apply a force pressing the second part towards the first part and wherein the shaft extends through respective through-holes of the force applying members and has respective first and second diameter portions associated with the force applying members, the second diameter portions being larger than the first diameter portions, whereby axial translation of the shaft relative to the force applying members move the shaft from a position in which the first diameter portions are received in the respective through-holes to a position in which the second diameter portions are received in the through-holes to cause the radially outward movement of the force applying members.

2. The vacuum system securing device of claim 1, wherein the shaft and the force applying members are configured to apply the pressing force in a radially outward direction with respect to the longitudinal axis.

3. The vacuum system securing device of claim 1, wherein the shaft is movable relative to the first part by rotation about the longitudinal axis.

4. The vacuum system securing device of claim 3, wherein the shaft is movable relative to the first part by axial translation of shaft relative to the first part.

5. The vacuum system securing device of claim 4, wherein the shaft is provided with threading configured to engage with threading attached to the first part, whereby the rotation of the shaft about the longitudinal axis causes the axial translation of the shaft.

6. The vacuum system securing device of claim 1, further comprising a mounting for the shaft that is securable to the first part, the mounting defining a bore in which the shaft is at least partially received and being provided with respective apertures through which the force applying members protrude, the apertures being configured to restrict movement of the force applying members in directions parallel to the longitudinal axis.

7. The vacuum system securing device of claim 6, wherein the apertures are each partially defined by opposed faces that restrict movement of the force applying members in the directions parallel to said longitudinal axis.

8. The vacuum system securing device of 1, further comprising a mounting for the shaft by which the shaft is attached to the first part, the relative movement of the shaft being relative to the mounting.

9. A vacuum system comprising a first part, a second part and a securing device releasably securing the first part to the second part, the securing device comprising:

a shaft supported by the first part and provided with a plurality of force applying members spaced from the first part to define a gap in which the second part is received by a movement of the second part in a lengthways direction of the shaft, the shaft having a longitudinal axis and being movable relative to the first part by axial sliding movement relative to the force applying members to cause the force applying members to narrow the gap to press the second part towards the first part to secure the second part to the first part wherein the force applying members each have a through-hole and the shaft extends through the through-holes, the shaft having a plurality of first diameter portions and a plurality of second diameter portions that have a diameter greater than the first diameter portions, and wherein the axial sliding movement moves the shaft from a position in which the first diameter portions are received in the respective through-holes to a position in which the second diameter portions are received in the through-holes to cause radially outward movement of the force applying members to narrow the gap.

10. The vacuum system of claim 9, wherein the shaft is movable relative to the first part by rotation about the longitudinal axis.

11. The vacuum system of claim 9, wherein the shaft comprises threading engaged with threading attached to the first part, whereby the rotation of the shaft causes the axial sliding movement of the shaft relative to the first part.

12. The vacuum system of claim 9 whereby the force applying members are movable to selectively vary the size of the gap.

13. The vacuum system of claim 12, further comprising a mounting for the shaft that is secured to the first part, the mounting defining a bore in which the shaft is at least partially received and being provided with respective apertures through which the force applying members protrude, the apertures being configured to restrict movement of the force applying members in directions parallel to the axis of rotation.

14. The vacuum system of claim 13, wherein the mounting is releasably securable to the first part.

15. The vacuum system of claim 9, further comprising a mounting for the shaft secured to the first part, the relative movement of the shaft being relative to the mounting.

16. The vacuum system securing device of claim 9, wherein the force applying members are disposed at axially spaced apart locations on the shaft.

17. The vacuum system of claim 9 wherein the second part is a part of a vacuum pump and the first part is a part of an apparatus having at least one interior space to be evacuated by the vacuum pump.

18. The vacuum system of claim 9, comprising two of the vacuum system securing devices, wherein the respective gaps defined by the securing devices define a guideway for the second part along which the second part is movable in directions parallel to the longitudinal axis of the shaft.

19. The vacuum system of claim 9, further comprising at least one sealing element sealing between the first and second parts.

* * * * *